US005514328A

United States Patent [19]

Menon et al.

[11] Patent Number: 5,514,328

[45] Date of Patent: May 7, 1996

[54] CAVITATION EROSION RESISTENT STEEL

[75] Inventors: Ravi Menon, Goodlettsville, Tenn.; William C. Mosier, Bowling Green, Ky.; James B. C. Wu, St. Louis, Mo.

[73] Assignee: Stoody Deloro Stellite, Inc., St. Louis, Mo.

[21] Appl. No.: 439,596

[22] Filed: May 12, 1995

[51] Int. Cl.[6] ..... C22C 38/52

[52] U.S. Cl. ..... 420/36; 420/585

[58] Field of Search ..... 420/36, 38, 585, 420/586

[56] References Cited

U.S. PATENT DOCUMENTS

| | | | |
|---|---|---|---|
| 2,496,246 | 1/1950 | Jennings | 75/128 |
| 2,536,034 | 1/1951 | Clarke, Jr. | 75/125 |
| 2,990,275 | 6/1961 | Binder et al. | 75/126 |
| 3,154,412 | 10/1964 | Kasak et al. | 75/126 |
| 3,251,683 | 5/1966 | Hammond | 75/128 |
| 3,340,048 | 9/1967 | Floreen | 75/128 |
| 3,719,476 | 3/1973 | Tanczyn | 75/125 |
| 3,772,005 | 11/1973 | deBarbadillo, II | 75/126 C |
| 3,873,378 | 3/1975 | Webster | 148/37 |
| 3,915,756 | 10/1975 | Oda et al. | 148/3 |
| 4,487,630 | 12/1984 | Crook et al. | 75/123 B |
| 4,588,440 | 5/1986 | Simoneau | 75/126 B |
| 4,751,046 | 6/1988 | Simoneau | 420/36 |

FOREIGN PATENT DOCUMENTS 2094342 9/1982 United Kingdom .

*Primary Examiner*—Deborah Yee
*Attorney, Agent, or Firm*—Grace J. Fishel

[57] ABSTRACT

A cavitation erosion resistant alloy comprising about 10 to 40 percent by weight of one or more carbide formers including some chromium, 5 to 15 percent by weight cobalt, 5 to 15 percent by weight manganese, 3.5 to 7.0 percent by weight silicon, 1.8 to 4.8 percent by weight nickel, 0.15 to 3.5 percent by weight carbon plus boron, up to 0.3 percent weight nitrogen and the balance being iron plus impurities.

7 Claims, 2 Drawing Sheets

CAVITATION EROSION RESISTENT STEEL

BACKGROUND OF THE INVENTION

1. Field of the Invention

The present invention relates to an iron-based alloy containing chromium, manganese, cobalt, carbon, silicon and nickel wherein the nickel is added in a range facilitating the addition of amounts of silicon which promote cavitation erosion resistance without unacceptable brittleness.

2. Brief Description of the Prior Art

Turbine blades in a hydroelectric generator undergo cavitation erosion. Cavitation erosion results from pressure differences in the water close to the surface of the blade. When the local pressure falls below the vapor pressure of the water, a cavity or vapor bubble develops in the liquid. When the pressure rises again above that of the vapor, the vapor bubble abruptly collapses sending a shock wave to the metal surface. Eventually, the metal in the blades fatigues, forms cracks and sections spall off. As cavitation erosion progresses, the rotor becomes unbalanced and the whole hydroelectric generator may begin to vibrate. To fix the problem, the rotor must be pulled from the generator and the damaged blades resurfaced by welding them with an alloy provided as a wire ductile enough to conform to the damaged blade. The repair is then ground to profile.

There are many weldable iron-cobalt-chromium alloys with excellent cavitation erosion resistance but not with the unique combination of features provided by the alloy described in this disclosure, including a balance of cavitation erosion resistance, ductility, hardness and cost. For example, STELLITE® 21 is a cavitation erosion resistant alloy used as reference standard against which other alloys are measured. STELLITE 21 typically contains, in weight percent, 27 chromium, 5.5 molybdenum, 2 nickel, 1.5 silicon and 0.25 carbon with the balance being cobalt and is expensive because of the high cobalt content. STELLITE is a registered trademark of Stoody Deloro Stellite, Inc. Another alloy sold by Stoody Deloro Stellite is TRISTELLE™ TS-2. This alloy is described in U.S. Pat. No. 4,487,630 to Crook et al. and contains, in weight percent, 35 chromium, 12 cobalt, 10 nickel, 4.9 silicon and 2 carbon with the balance being iron. According to U.S. Pat. No. 4,487,630, levels of nickel above 5% by weight are required to promote an austenitic structure. TRISTELLE TS-2 is more resistant to cavitation than STELLITE 21 and is less expensive because it contains less cobalt; however, TRISTELLE TS-2 is brittle, making it crack sensitive when welded. It is also very hard, making it difficult to grind to a smooth profile when it is used to resurface turbine blades. Other weldable, cavitation erosion resistant alloys include HQ 913®, an alloy described in U.S. Pat. Nos. 4,588,440 and 4,751,046, assigned to Hydro Quebec of Montreal, Canada. HQ 913 is another registered trademark of Stoody Deloro Stellite, Inc. HQ 913 typically contains, in weight percent, 17.0 chromium, 10.0 manganese, 9.5 cobalt, 2.8 silicon, 0.25 nickel, 0.20 nitrogen and 0.17 carbon with the balance being iron. The amount of silicon in HQ 913 is restricted by the amount of nickel which, in turn, is limited by phase requirements.

Each of the above-mentioned iron-cobalt-chromium alloys differs in some subtle way from the others, providing a different alloy suited for certain specific uses. Such differences include, for example, a new range of an effective element or a critical ratio of certain elements already specified with valuable advances in alloy development being made in small unexpected, but effective increments.

SUMMARY OF THE INVENTION

In view of the above, it is an object of the present invention to provide a chromium-cobalt-nickel alloy with superior cavitation erosion resistance. Another object is to provide an alloy having superior cavitation erosion resistance with acceptable ductility, hardness and cost. Other objects and features of the invention will be in part apparent and in part pointed out hereinafter.

In accordance with the invention, a cavitation erosion resistant alloy consisting essentially of about 10 to 40 percent by weight of a carbide former, 5 to 15 percent by weight cobalt, 5 to 15 percent by weight manganese, 3.5 to 7.0 percent by weight silicon, 1.8 to 4.8 percent by weight nickel, 0.15 to 3.5 percent by weight carbon plus boron, up to 0.3 percent weight nitrogen and the balance being iron plus normal impurities. In preferred embodiments of the alloy, the silicon to nickel ratio is within a range of about 1:1 to 4:1 on a weight basis and the alloy has a ferrite number of at least 0.2.

The invention summarized above comprises the constructions hereinafter described, the scope of the invention being indicated by the subjoined claims.

BRIEF DESCRIPTION OF THE DRAWINGS

The cavitation erosion resistance of steels of this invention and comparisons thereof with other steels, including prior art steels, is graphically depicted by the accompanying drawings, wherein.

DETAILED DESCRIPTION OF THE INVENTION

Figure 1:
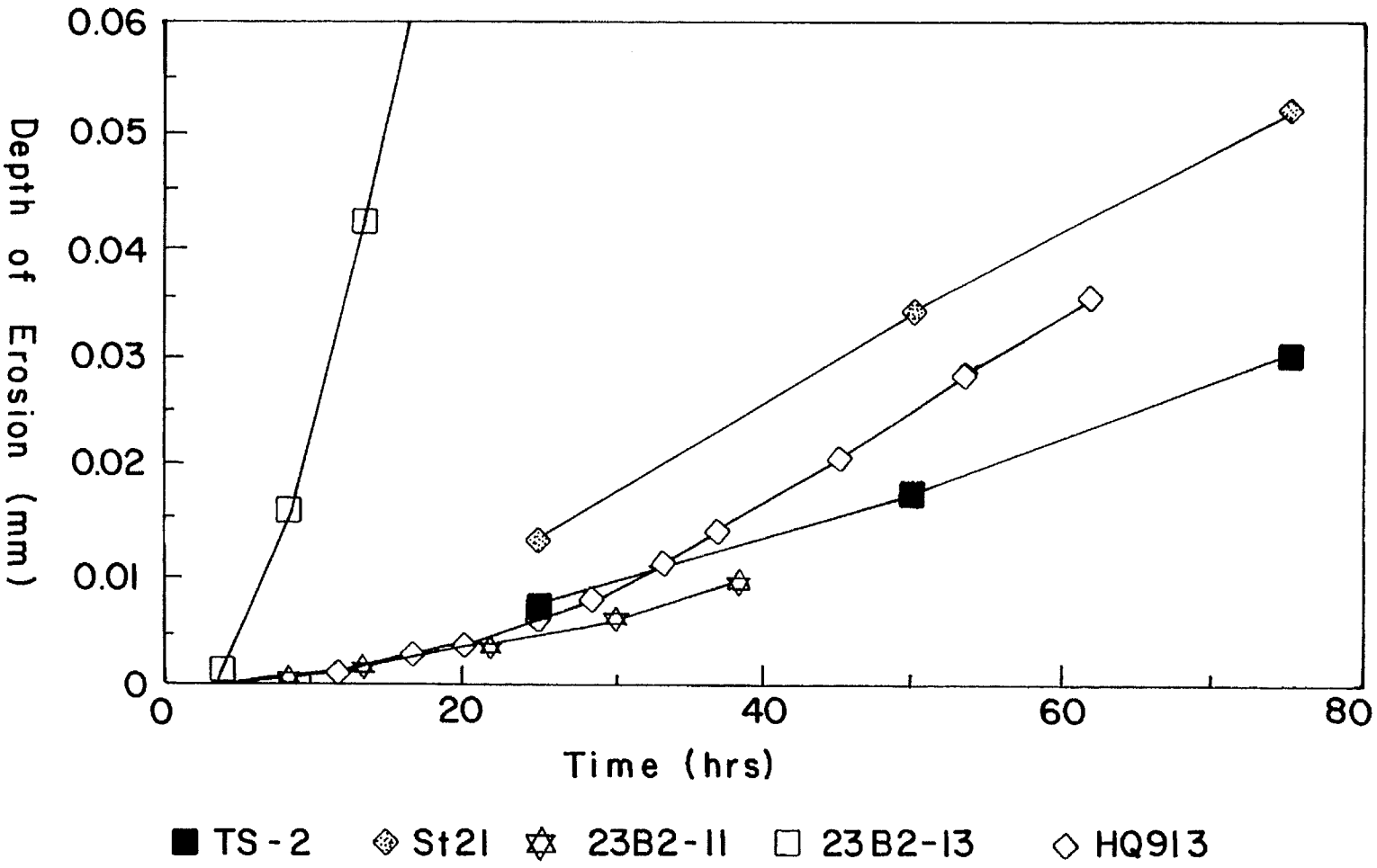
FIG. 1 shows ASTM G-32 cavitation erosion results for a series of alloys described in Example 2. Sample 23B2-11 is an alloy in accordance with the present invention. Sample 23B2-13 is an alloy with a silicon/nickel ratio less than 1, Sample TS-2 is TRISTELLE TS-2, Sample St21 is STELLITE 21 and HQ 913 is HYDROLOY® 913, prior art steels for purposes of comparison with Sample 23B2- 11 (HYDROLOY is a registered trademark of Stoody Deloro Stellite, Inc.)
Figure 2:
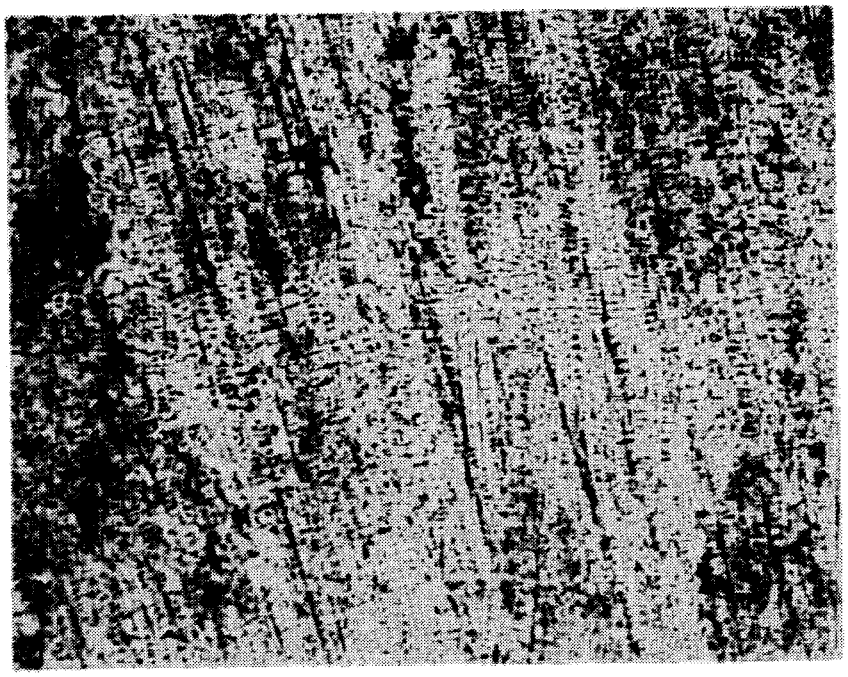
FIG. 2 is a photomicrograph at 100 magnification showing surface details of Sample 23B2-11 etched with Kallings reagent; and, FIG. 3 is a photomicrograph at 500 magnification showing surface details of Sample 23B2-11 etched with Kallings reagent.
Figure 3:
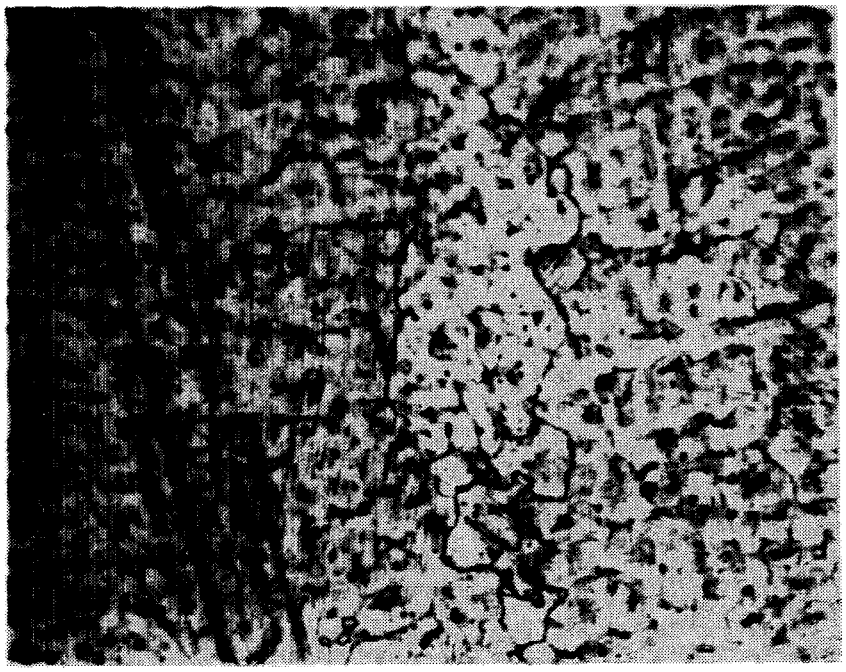

The alloys of the present invention contain about 10 to 40 percent by weight of one or more carbide formers including some chromium, 5 to 15 percent by weight cobalt, 5 to 15 percent by weight manganese, 3.5 to 7.0 percent by weight silicon, 1.8 to 4.8 percent by weight nickel, 0.15 to 3.5 percent by weight carbon plus boron, up to 0.3 percent weight nitrogen and the balance being iron plus impurities. Other carbide formers, in addition to chromium, include any one or a combination of molybdenum, tungsten, vanadium, tantalum, niobium, zirconium, hafnium and titanium; however, the carbide former may be entirely chromium.

In the range stated above, silicon increases hardness and cavitation erosion resistance without making the alloy too brittle if nickel is also added in the range stated above. For best results, the silicon to nickel ratio on a weight percent basis is within a range of about 1:1 to 4:1 which corresponds to an atom ratio of silicon to nickel of about 2:1 to 8:1. While the silicon and nickel are preferably in the above-mentioned ratios this does not imply that there is necessarily an intimate chemical association between the silicon and the nickel in the alloy. The amount of silicon and nickel and the ratio of the silicon to the nickel do have a substantial effect on the physical properties of the alloy including having an effect on cavitation erosion resistance, ductility and hardness. Cost is also affected because cobalt levels need not be increased above the stated range to improve cavitation erosion resistance. It is also preferred that the alloy have a ferrite number of at least 0.2 to avoid a fully austenitic structure which could cause hot cracking during welding.

Even better results are obtained and it is further preferred that the alloys of the present invention contain about 14 to 24 percent by weight chromium, 6 to 10 percent by weight cobalt, 6 to 12 percent by weight manganese, 4.0 to 5.0 percent by weight silicon, 1.8 to 2.8 percent by weight nickel, 0.15 to 3.0 percent by weight carbon plus boron, up to 0.3 percent weight nitrogen and the balance being iron plus impurities. The best alloy presently identified within the above-mentioned range has a composition of about 17 percent by weight chromium, 10 percent by weight cobalt, 10 percent by weight manganese, 4.6 percent by weight silicon, 2.0 percent by weight nickel, 0.22 percent by weight carbon plus boron, up to 0.3 percent weight nitrogen and the balance being iron plus impurities.

While the focus of the Brief Description of the Prior Art and the Examples is on providing a weldable alloy, it should be understood that articles can be formed from the alloys of this invention by melting and casting or otherwise thermomechanically processing the alloy. The alloy can be preformed or it can be formed from unalloyed mixtures of the necessary components. The preformed alloy can be made in the form of powder or articles made thereof.

In the following examples, alloys that illustrate the invention are noted, the others being prepared for purposes of comparison.

EXAMPLE 1

A series of alloys was produced in the form of weld deposits on mild steel plate using a plasma transfer arc welding (PTA) process. Powders having a target composition given in Table I were mixed thoroughly and loaded into the powder feeder of the PTA machine. The mixture was welded on a 2 by 2 inch by 0.5 inch mild steel plate. Two passes were made to make an overlay about 0.125 inch thick.

Erosion cavitation tests were conducted directly on the weld deposits. The test procedure consisted of directing a nozzle emitting a 10,000 psi water jet stream toward the surface of the test specimens which was immersed in water. The nozzle traveled across the specimen back and forth following the same path for 10 hours. The test was stopped to allow for examination of the specimen for cavitation damages. The test was then resumed for another 10 hours because most of the specimens did not show any significant damage. The damage on the specimens in terms of depth and width was measured by a profilometer. The results are reported in Table I.

Sample 7 is in accordance with the invention, all other samples are for purposes of comparison. In general the data show that high levels of nickel (e.g., 6% by weight) are detrimental to cavitation resistance and silicon compensates for the detrimental effect of nickel. Cobalt and chromium are also beneficial but less effective than silicon. Molybdenum is beneficial and lower manganese is also beneficial in the presence of nickel.

TABLE I

| | Test Alloys | | | | | | | | | |
|---|---|---|---|---|---|---|---|---|---|---|
| | Weight Percent | | | | | | | DAMAGE IN MILS* | | |
| SAMPLE | Co | Cr | N | Si | Ni | Mn | Mo | WDTH | DPTH | W × D |
| HQ 913 ® | 9.5 | 17 | 0.18 | 3.5 | 0 | 10 | | 45 | 0.4 | 17 |
| 7 | 9.5 | 17 | 0.18 | 3.5 | 2 | 10 | | 74 | 0.7 | 52 |
| 2 | 9.5 | 17 | 0.18 | 7 | 6 | 10 | | 73 | 0.8 | 56 |
| 3 | 15 | 17 | 0.18 | 3.5 | 6 | 10 | | 113 | 3.0 | 333 |
| 6 | 9.5 | 25 | 0.18 | 3.5 | 6 | 10 | | 117 | 3.0 | 354 |
| 5 | 9.5 | 17 | 0.18 | 3.5 | 6 | 10 | 3 | 120 | 3.1 | 368 |
| 8 | 9.5 | 17 | 0.18 | 3.5 | 6 | 5 | | 109 | 3.7 | 399 |
| 4 | 9.5 | 17 | 0.18 | 3.5 | 6 | 10 | 1 | 128 | 5.8 | 746 |
| 1 | 9.5 | 17 | 0.18 | 3.5 | 6 | 10 | | 131 | 8.1 | 1057 |
| 9 | 9.5 | 17 | 0 | 3.0 | 6 | 8 | | 151 | 8.4 | 1271 |

HQ 913 has 0.17% C and others 0.25% C.
HQ 913 was welded by gas tungsten arc welding (GTAW) by twisting two 0.045" wires.
Other samples were welded by PTA with blended powder.
*After 20 hours Sample 7 and Sample 2, being the most promising, were subjected to elemental analysis. The carbon and sulfur were analyzed used the Leco technique, having a degree of accuracy of about 5%. The other elements such as chromium, nickel and silicon were analyzed using x-ray fluorescence, having a degree of accuracy of about 10%. The elemental composition of Sample 7, in weight percent, was 10.3 cobalt, 17.5 chromium, 3.3 silicon, 2.3 nickel, 10.1 manganese, carbon 0.25, phosphorus 0.011, 0.018 sulfur and balance iron. The elemental composition of Sample 2 was 9.7 cobalt, 16.9 chromium, 3.3 silicon, 6.5 nickel, 9.5 manganese, carbon 0.27, phosphorus 0.014, 0.028 sulfur and balance iron. The analyzed composition is consistent with the starting material composition within the range of analytical accuracy.

EXAMPLE 2

A series of alloys was produced in the form of tube wire having a diameter of 0.045". Each wire was prepared by forming a strip of AISI (American Iron and Steel Institute)

430 steel into a U-shaped tube and feeding a dry blend of alloy powder ("fill") in a precise ratio of alloy powder to wire weight, using care to balance the composition of the metal tube and the alloy powder so that the elemental compositions of the alloys as weld deposits were as given in Table II. AISI 430 steel contains, in percent by weight, up to 0.07 carbon maximum, 15.5 to 17.0 chromium, up to 0.50 nickel maximum, 0.20 to 0.70 silicon (typically 0.50) and the balance iron plus normal impurities.

Each tube was closed after it was filled and drawn to size in a draw bench through a series of 6 or 7 dies of decreasing opening. A draw lubricant was used in the die box to prevent overheating. The wire at final diameter was baked to remove most of the draw lubricant which might otherwise interfere with the weldability of the wire.

Weld pads were then made with the 0.045" diameter wires by depositing the alloy on ASTM A36 base steel measuring 1 by 6 inches with a thickness of 1 inch using gas metal arc welding (GMAW). Until deposited on the base, the fill was discrete from the strip with the alloy being formed in the GMAW process. The welding parameters were 180–200 amps at 27 volts, DC electrode positive, with 98% by volume argon-2% by volume oxygen as the shielding gas. Six layers of weld metal were deposited to build up a minimum thickness of at least 1" which ensured that the test surface of the specimen was an undiluted weld metal composition. The maximum interpass of the weld pad temperature was 600° F.

To determine the resistance of each alloy to cavitation erosion, standard tests per ASTM G-32 were conducted at a test frequency of 20 KHz on two standard test specimens cut from each pad after welding was completed. The average of the results from the two specimens are plotted in FIG. 1 as depth of erosion v. time for samples 23B2-11 and 23B2-13. Comparable erosion data for STELLITE 21, TRISTELLE TS-2 and HQ 913 are also plotted for reference.

Samples were also prepared and tested for tensile strength, yield strength, elongation and hardness. The results are reported in Table II.

Sample 23B2-11 is in accordance with the invention, all other samples are for purposes of comparison. Samples 23B2-10 and 23B2-12 contained, in weight percent, 3.3 and 3.4 silicon, respectively, and 2.0 nickel, sample 23B2-13 contained 1.7 silicon and 6.8 nickel and sample 23B2-18 contained 7.1 silicon and 8.0 nickel. Sample 23B2-18 was brittle and cracked during welding.

Tensile tests were conducted on all weld metal specimens from these wires. The results show that a relatively high silicon to nickel ratio results in lower elongation or ductility. The lowest silicon to nickel ratio (23B2-13) resulted in the highest elongation or ductility.

At the highest level of silicon tested (23B2-18) the sample bar cracked during welding indicating an alloy of very low ductility. This was confirmed with hardness test results which indicated that this alloy had the highest hardness of the alloys tested.

TABLE II

| | Test Alloys* | | | | |
|---|---|---|---|---|---|
| Sample | 23B2-10 | 23B2-11 | 23B2-12 | 23B2-13 | 23B2-18 |
| C | 0.21 | 0.22 | 0.19 | 0.17 | 0.28 |
| Mn | 9.6 | 10.0 | 4.9 | 8.8 | 10.3 |
| si | 3.3 | 4.6 | 3.4 | 1.7 | 7.1 |

TABLE II-continued

| | Test Alloys* | | | | |
|---|---|---|---|---|---|
| Sample | 23B2-10 | 23B2-11 | 23B2-12 | 23B2-13 | 23B2-18 |
| Cr | 16.8 | 16.5 | 16.4 | 16.2 | 15.1 |
| Ni | 2.0 | 2.0 | 2.0 | 6.8 | 8.0 |
| Mo | — | — | — | 0.4 | — |
| Co | 9.7 | 10.1 | 9.7 | 7.6 | 9.9 |
| N | 0.24 | 0.23 | 0.29 | — | 0.23 |
| Fe | Bal | Bal | Bal | Bal | Bal |
| Tensile Strength (ksi)*** | 146.6 | 135.1 | 120.2 | 102.1 | ** |
| Yield Strength (ksi)*** | 92.0 | 94.5 | 86.0 | 66.3 | ** |
| Elongation (% in 1 in.) | 23.1 | 11.1 | 11.7 | 40.5 | ** |
| Hardness (HRC) | 26 | 28 | 28 | 18 | 36 |

*Elemental composition is expressed as weight percent.
**No mechanical data for this alloy. Tensile bar cracked during welding.
***Kips (one thousand pounds) per square inch.

EXAMPLE 3

A series of alloys was produced in the form of tube wire having a diameter of 0.045" having the elemental composition given in Table III. Weld pads were made with the 0.045" wire by depositing the alloy on AISI 1020 plate measuring 2 by 6 inches with a thickness of ⅜ inch using a GMAW process. The welding parameters were 110–115 amps, DC electrode negative, and with a pulsed frequency of 120 Hz. The shielding gas was 75% by volume argon-25% by volume carbon dioxide. Two layers of weld metal were deposited with a maximum interpass temperature of 350° F. for the weld deposit. The weld assembly was clamped down to prevent distortion.

After the second layer was deposited, the specimen was reduced symmetrically to a width of 1 inch so as to remove end effects. The deposit surface was ground to a new deposit thickness of 0.25–0.3 inch. The deposits were then bent in three-point bending with a 1.5 inch mandrel with the weld overlay in tension. The bend angle at which the specimen failed was measured and is reported in Table III.

The ferrite number was measured before and after bending with a ferritescope and Rockwell hardness was measured after welding. A ferritescope works on the magnetic induction principle, whereby the ferrite content is obtained from the magnetic permeability. Since the ferrite phase is magnetic and the austenite phase non-magnetic, a relative measure of the magnetic permeability is calibrated to a ferrite number (FN). The ferrite number is approximately equal to the % ferrite plus martensite within the 0–20 FN range. The FN and Rockwell hardness are reported in Table III.

Sample 23B2-19 is in accordance with the invention, all other samples are for purposes of comparison. To improve cavitation erosion resistance over HQ 913, the silicon content was increased but this reduced ductility. An addition of 1% by weight of nickel increased the bend ductility. A further increase of the nickel content to 2% resulted in a significant improvement in the bend ductility. Reducing the silicon content (23B2-10) retained the ductility. Increasing the nickel content to 5% had an unusual effect on the bend ductility in that the sample was the poorest of the set and examination of the specimens showed evidence of hot cracking on the surface.

The data indicate that the addition of nickel decreased the ferrite number. A ferrite reading was not registered on the deposit with the highest nickel content (23B2-23) indicating that the fully austenitic nature of the deposit was potentially responsible for the hot cracking noted on the surface. The ferrite numbers for HQ 913 and Sample 23B2-19 indicate a somewhat significant increase after bending which is probably a measure of the transformation from austenite to martensite. Increasing the silicon content increased hardness whereas increasing the nickel content reduced the hardness. This is in line with the bend ductility and tensile elongation results.

TABLE III

| | Test Alloys* | | | | | |
|---|---|---|---|---|---|---|
| SAMPLE | HQ913 ® | 23B2-20 | 23B2-22 | 23B2-19 | 23B2-10 | 23B2-23 |
| C | 0.17 | 0.20 | 0.19 | 0.22 | 0.21 | 0.20 |
| Mn | 10.0 | 9.7 | 10.2 | 10.0 | 9.6 | 10.0 |
| Si | 2.8 | 4.0 | 4.4 | 4.6 | 3.3 | 4.2 |
| Cr | 17.0 | 17.3 | 17.5 | 16.5 | 16.8 | 17.0 |
| Ni | 0.25 | 0.25 | 1.2 | 2.0 | 2.0 | 5.0 |
| Co | 9.5 | 9.7 | 10.3 | 10.1 | 9.7 | 9.9 |
| N | 0.20 | 0.20 | 0.19 | 0.23 | 0.24 | 0.20 |
| Fe | Bal | Bal | Bal | Bal | Bal | Bal |
| FN-AW | 1.2 | 6.9 | 2.8 | 0.23 | 0.3 | NR |
| FN-AB | 3.3 | 7.1 | 2.8 | 0.7 | 0.8 | NR |
| HRC-AW | 21.5 | 28.5 | 25 | 24.5 | 19 | 19.5 |
| Bend Angle (degrees) | >40 | 11 | 30 | >40 | >40 | 5.5[B] |

FN-AW = Ferrite Number-As Welded
FN-AB = Ferrite Number-After Bending
HRC-AW = Hardness, Rockwell C-As Welded
NR = Not Recordable
B = Hot cracks on surface
*Elemental composition is expressed as weight percent.

The above examples demonstrate that an improvement in cavitation resistance requires an increase in the silicon content. However, an increase in the silicon content has to be matched with a concomitant increase in the nickel content to maintain ductility. Silicon content increases to about the 5% level are preferred as high silicon contents as in 23B2-18 (7% silicon and 8% nickel) result in very poor ductility. At the 5% silicon level, a nickel content of about 2% is preferred as it results in superior cavitation resistance (better than HQ 913) and acceptable ductility. The upper limit of nickel content as this silicon level is about 5% as hot cracking will result in the deposit at a higher nickel level. At lower silicon levels (1.7%) an increase in the nickel content to 6.8% can increase ductility significantly, however, at the cost of cavitation resistance (23B2-13).

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A cavitation erosion resistant alloy comprising about 10 to 40 percent by weight of one or more carbide formers including some chromium, 5 to 15 percent by weight cobalt, 5 to 15 percent by weight manganese, 3.5 to 7.0 percent by weight silicon, 1.8 to 4.8 percent by weight nickel, 0.15 to 3.5 percent by weight carbon plus boron, up to 0.3 percent weight nitrogen and the balance being iron plus impurities.

2. The alloy of claim 1 wherein the silicon to nickel ratio on a weight percent basis is within a range of about 1:1 to 4:1.

3. The alloy of claim 2 wherein the alloy has a ferrite number of at least 0.2.

4. The alloy of claim 3 wherein the carbide former is all chromium.

5. A cavitation erosion resistant alloy comprising about 14 to 24 percent by weight chromium, 6 to 10 percent by weight cobalt, 6 to 12 percent by weight manganese, 4.0 to 5.0 percent by weight silicon, 1.8 to 2.8 percent by weight nickel, 0.15 to 3.0 percent by weight carbon plus boron, up to 0.3 percent weight nitrogen and the balance being iron plus impurities.

6. The alloy of claim 5 wherein the alloy has a ferrite number of at least 0.2.

7. A cavitation erosion resistant alloy comprising about 17 percent by weight chromium, 10 percent by weight cobalt, 10 percent by weight manganese, 4.6 percent by weight silicon, 2.0 percent by weight nickel, 0.22 percent by weight carbon plus boron, up to 0.3 percent weight nitrogen and the balance being iron plus impurities.

* * * * *